US008079214B2

(12) United States Patent
Son et al.

(10) Patent No.: US 8,079,214 B2
(45) Date of Patent: Dec. 20, 2011

(54) INTEGRALLY FORMED ENGINE EXHAUST MANIFOLD AND CYLINDER HEAD

(75) Inventors: Jin Wook Son, Gunpo (KR); Jin Kook Kong, Suwon (KR); Young Jin Won, Hwseong (KR); Jei Choon Yang, Yongin (KR); Jin Soon Kim, Yongin (KR)

(73) Assignee: Hyundai Motor Company, Seoul (KR)

( * ) Notice: Subject to any disclaimer, the term of this patent is extended or adjusted under 35 U.S.C. 154(b) by 608 days.

(21) Appl. No.: 12/323,465

(22) Filed: Nov. 25, 2008

(65) Prior Publication Data

US 2009/0151343 A1 Jun. 18, 2009

(30) Foreign Application Priority Data

Dec. 14, 2007 (KR) ..... 10-2007-0131570
Apr. 21, 2008 (KR) ..... 10-2008-0036815

(51) Int. Cl.
*F01N 1/00* (2006.01)

(52) U.S. Cl. ..... 60/323

(58) Field of Classification Search ..... 60/323
See application file for complete search history.

(56) References Cited

U.S. PATENT DOCUMENTS 4,077,210 A * 3/1978 Ohki et al. ..... 60/282
5,349,817 A * 9/1994 Bekkering ..... 60/322
6,302,754 B1 * 10/2001 Kashima ..... 440/88 R
6,511,356 B2 * 1/2003 Yukishima ..... 440/89 R
6,725,656 B2 * 4/2004 Moore et al. ..... 60/323
7,128,052 B1 * 10/2006 Reed et al. ..... 123/406.45
2001/0050070 A1 * 12/2001 Xu et al. ..... 123/295
2003/0221426 A1 * 12/2003 Bruce et al. ..... 60/323
2004/0065279 A1 * 4/2004 Hitomi et al. ..... 123/58.8
2005/0252464 A1 * 11/2005 Aikawa et al. ..... 123/58.8
2006/0032219 A1 * 2/2006 Dirker ..... 60/323
2006/0037592 A1 * 2/2006 Pacitti et al. ..... 123/568.14
2008/0047262 A1 * 2/2008 Chu ..... 60/323

FOREIGN PATENT DOCUMENTS

JP 2005-188352 A 7/2005
JP 2007205174 A * 8/2007
KR 1999-0059913 A 7/1999

OTHER PUBLICATIONS

English translation of JP 2007-205174A.*

* cited by examiner

*Primary Examiner* — Thomas Denion
*Assistant Examiner* — Jason Shanske
(74) *Attorney, Agent, or Firm* — Morgan, Lewis & Bockius LLP

(57) ABSTRACT

An engine in which an exhaust manifold is integrally formed with a cylinder head may include the exhaust manifold in which at least one passage, which is connected to at least one exhaust port disposed in a first cylinder, and at least one passage, which is connected to at least one exhaust port disposed in a second cylinder, are formed, wherein the passage at the first cylinder and the passage at the second cylinder join together to communicate with a first single exhaust outlet.

16 Claims, 8 Drawing Sheets

INTEGRALLY FORMED ENGINE EXHAUST MANIFOLD AND CYLINDER HEAD

CROSS-REFERENCE TO RELATED APPLICATION

This application claims priority to Korean Patent Applications No. 10-2007-0131570 and 10-2008-0036815 filed on Dec. 14, 2007 and Apr. 21, 2008, respectively, the entire contents of which applications is incorporated herein for all purposes by this reference.

BACKGROUND OF THE INVENTION

1. Field of the Invention

The present invention relates to an exhaust system of an engine, and more particularly to an exhaust system in which a cylinder head and an exhaust manifold are integrally formed.

2. Description of Related Art

Generally, an internal combustion engine is equipped with an exhaust system for exhausting exhaust gas that is combusted inside a cylinder.

An exhaust port is formed in the cylinder head so as to exhaust the exhaust gas from the cylinder. The exhaust gas that is exhausted from the exhaust port is supplied to a catalytic converter through the exhaust manifold.

The exhaust manifold is fabricated as a separate component and is assembled to the cylinder head by bolts etc.

The exhaust manifold is exposed to atmosphere and is prepared as a separate member from the cylinder head such that the exhaust manifold cannot be cooled by a water jacket but can be cooled by ambient air.

If the exhaust system for exhausting the exhaust gas from the cylinder to the catalytic converter is compactly designed, the engine compartment can be efficiently used.

Also, the exhaust system has been developed to improve durability thereof and to sustain an appropriate temperature of the exhaust gas that is transferred to the catalytic converter.

However, the exhaust gas is not efficiently cooled such that the exhaust resistance and the fuel consumption increase. In addition, the exhaust manifold is separately assembled to the engine such that the assembly cost increases and the engine compartment structure is complicated. In addition, there is a problem that noise is generated from the exhaust manifold by the exhaust gas.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine in which an exhaust manifold is integrally formed with a cylinder head having advantages of controlling temperature of an exhaust gas and improving a spatial utility of an engine compartment.

An engine in which an exhaust manifold is integrally formed with a cylinder head may include the exhaust manifold in which at least one passage, which is connected to at least one exhaust port disposed in a first cylinder, and at least one passage, which is connected to at least one exhaust port disposed in a second cylinder, are formed, wherein the passage at the first cylinder and the passage at the second cylinder join together to communicate with a first single exhaust outlet. The first single exhaust outlet may be extended and bent at a predetermined angle in a range of about 30° to about 60°.

A first exhaust port may be formed in the first cylinder, and second and third exhaust ports are formed in the second cylinder that is adjacent to the first cylinder, and wherein a first passage at the first cylinder communicates with the first exhaust port and a second passage at the second cylinder communicates with the second exhaust port.

First and second exhaust ports may be formed in the first cylinder and third and fourth exhaust ports may be formed in the second cylinder that is adjacent to the first cylinder, and herein a first passage at the first cylinder communicates with the first and second exhaust ports and a second passage at the second cylinder communicates with the third exhaust port. A third cylinder that is formed adjacent to the second cylinder and that has fifth and sixth exhaust ports may be included, wherein a third passage that communicates with the fourth exhaust port and a fourth passage that communicates with the fifth exhaust port are formed in the exhaust manifold, and the third and fourth passages join together to communicate with a second single exhaust outlet. The second single exhaust outlet and the first single exhaust outlet may be adjoined. The first single exhaust outlet and the second single exhaust outlet may be extended and bent at a predetermined angle in a range of about 30° to about 60° and wherein the first single exhaust outlet and the second single exhaust outlet are formed to an exhaust flange with a predetermined distance therebetween, wherein the predetermined distance may be in a range of about 3 mm to about 15 mm. A fourth cylinder in which seventh and eighth exhaust ports are formed and that is disposed next to the third cylinder may be further included, wherein a fifth passage that communicates with the sixth exhaust port and a sixth passage that communicates with the seventh and eighth exhaust ports are formed in the exhaust manifold, and the fifth and sixth passages join together to communicate with a third single exhaust outlet, wherein the first, second, and third single exhaust outlets may be extended and bent at a predetermined angle in a range of about 30° to about 60°, and wherein the first, second, and third single exhaust outlets may be formed to an exhaust flange with a predetermined distance therebetween in series, wherein the predetermined distance is in a range of about 3 mm to about 15 mm. The fifth passage may be joined with the sixth passage after the sixth passage is formed.

In another aspect, the first passage and the second passage may join together to communicate with the first single exhaust outlet. A third cylinder in which fifth and sixth exhaust ports are formed and that adjoins the second cylinder may be included, wherein a third passage that communicates with the fourth exhaust port and a fourth passage that communicates with the fifth and sixth exhaust ports are formed, and the third and fourth passages join together to communicate with a second single exhaust outlet. The third passage may be joined with the fourth passage after the fourth passage is formed. The first, second, and third single exhaust outlets may be extended and bent at a predetermined angle in a range of about 30° to about 60°, and wherein the first, second, and third single exhaust outlets are formed to an exhaust flange with a predetermined distance therebetween in series, wherein the predetermined distance may be in a range of about 3 mm to about 15 mm.

In further another aspect, an engine in which an exhaust manifold is integrally formed with a cylinder head, may include a first cylinder that includes first and second exhaust ports, a second cylinder that includes third and fourth exhaust ports and is disposed adjacent to the first cylinder, a third cylinder that includes fifth and sixth exhaust ports and is disposed adjacent to the second cylinder, and/or the exhaust manifold in which a first passage that communicates with the first and second exhaust ports, a second passage that communicates with the third and fourth exhaust ports, and a third exhaust passage that communicates with the fifth exhaust port are formed, wherein the first passage is connected to a first single exhaust outlet, and the second passage and the third passage join together to communicate with a second single exhaust outlet. The third passage may be joined with the second passage after the second passage is formed. The first single exhaust outlet and the second single exhaust outlet may be extended and bent at a predetermined angle in a range of about 30° to about 60°, and wherein the first single exhaust outlet and the second single exhaust outlet are formed to an exhaust flange with a predetermined distance therebetween, wherein the predetermined distance may be in a range of about 3 mm to about 15 mm. A fourth cylinder that includes seventh and eighth exhaust ports and is formed adjacent to the third cylinder may be included, wherein a fourth passage that communicates with the sixth exhaust port and a fifth passage that communicates with the seventh and eighth exhaust ports are formed in the exhaust manifold, and the fourth and fifth passages join together to communicate with a third single exhaust outlet. The first, second, and third single exhaust outlets may be extended and bent at a predetermined angle in a range of about 30° to about 60°, and wherein the first, second, and third single exhaust outlets are formed to an exhaust flange with a predetermined distance therebetween in series, wherein the predetermined distance may be in a range of about 3 mm to about 15 mm. The fifth passage may be joined with the fourth passage after the fifth passage is formed.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An engine in which an exhaust manifold is integrally formed with a cylinder head is explained in the following according to various embodiments of the present invention, while referring to the accompanying drawings.

Figure 1:
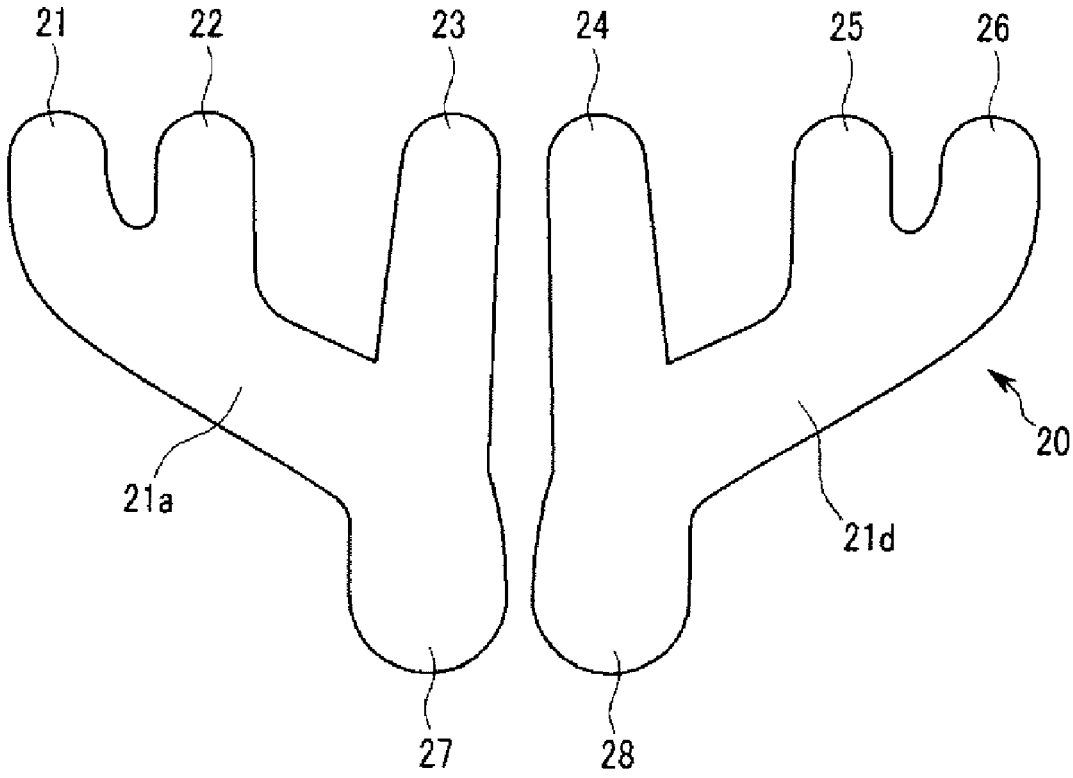
FIG. 1 is a schematic diagram of an exhaust manifold portion according to aspect of the present invention.
Figure 2:
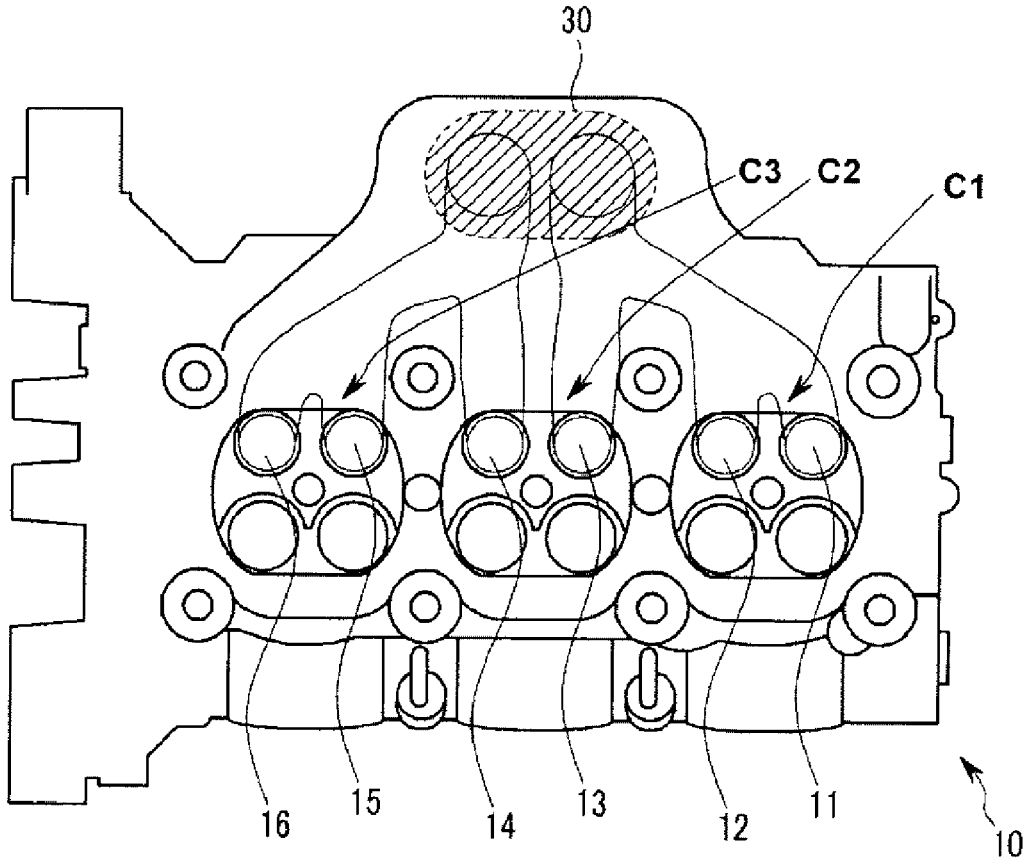
FIG. 2 is a plane cross-sectional view of a cylinder head and exhaust system according to aspect of the present invention.

FIG. 1 is a schematic diagram of an exhaust manifold portion according to an aspect of the present invention, FIG. 2 is a plane cross-sectional view of a cylinder head and exhaust system according to an aspect of the present invention, and FIG, 3 is a partial side cross-sectional view of a cylinder head and exhaust system according to an aspect of the present invention.

Figure 3:
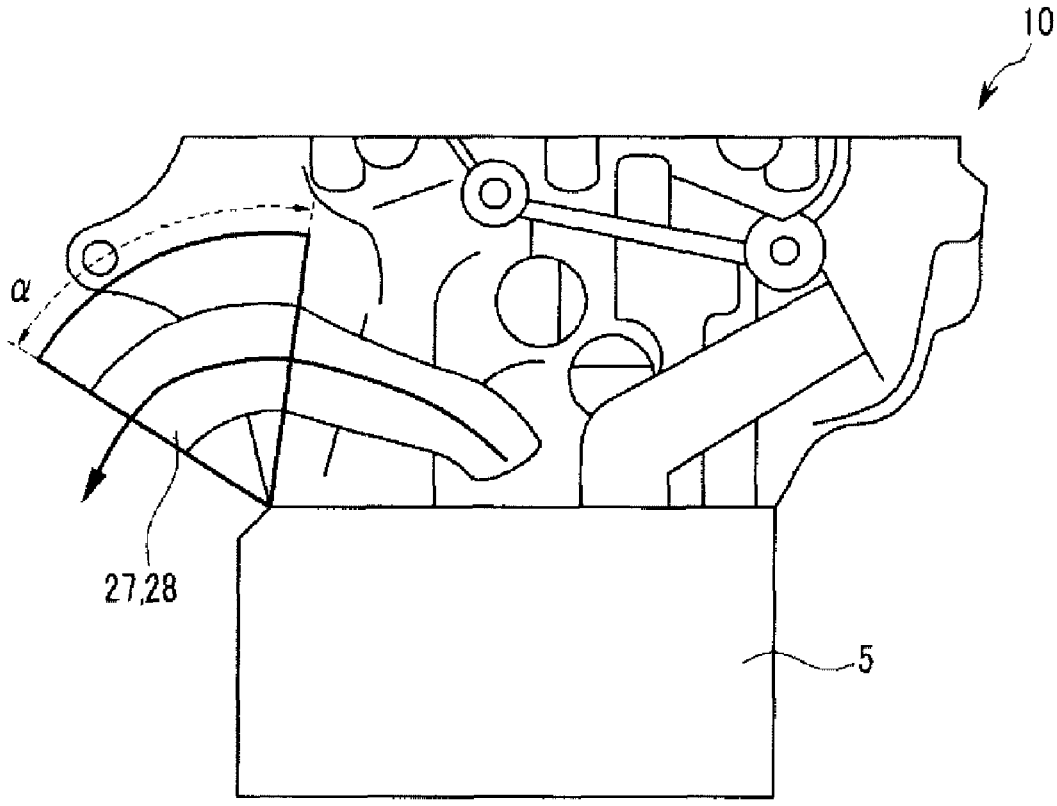
FIG. 3 is a partial side cross-sectional view of a cylinder head and exhaust system according to an aspect of the present invention.

Referring to FIG. 1 to FIG. 3, a cylinder head and exhaust system includes a cylinder head 10 that is installed to an engine 5, an exhaust port portion that is formed in the cylinder head 10, and an exhaust manifold portion 20 that is connected to the exhaust port and is formed with the cylinder head in various embodiments of the present invention.

The engine 5 has three cylinders C1, C2 and C3, and the exhaust port portion includes a first, second, third, fourth, fifth, and sixth exhaust ports 11, 12, 13, 14, 15, and 16. And, only one bank on the two banks is explained in connection with various embodiments of the present invention.

The exhaust manifold portion 20 includes first, second, third, fourth, fifth, and sixth exhaust passages 21, 22, 23, 24, 25, and 26 that are respectively connected to a first, second, third, fourth, fifth, and sixth exhaust ports 11, 12, 13, 14, 15, and 16.

The first and second exhaust passage 21 and 22 join together to form a first passage 21*a* and the fifth and sixth exhaust passage 25 and 26 join together to form a second passage 21*d*.

Referring to FIG. 1, the first passage 21*a* and the third exhaust passage 23 join together to communicate with a first single exhaust outlet 27, and the second passage 21*d* and the fourth exhaust passage 24 join together to communicate with a second single exhaust outlet 28.

The first passage 21*a* and the third exhaust passage 23 are smoothly connected such that deformation by heat stress can be minimized.

The second passage 21*d* and the fourth exhaust passage 24 are smoothly connected to minimize deformation by heat stress, and simultaneously the design of the water jacket can be easier.

Figure 4:
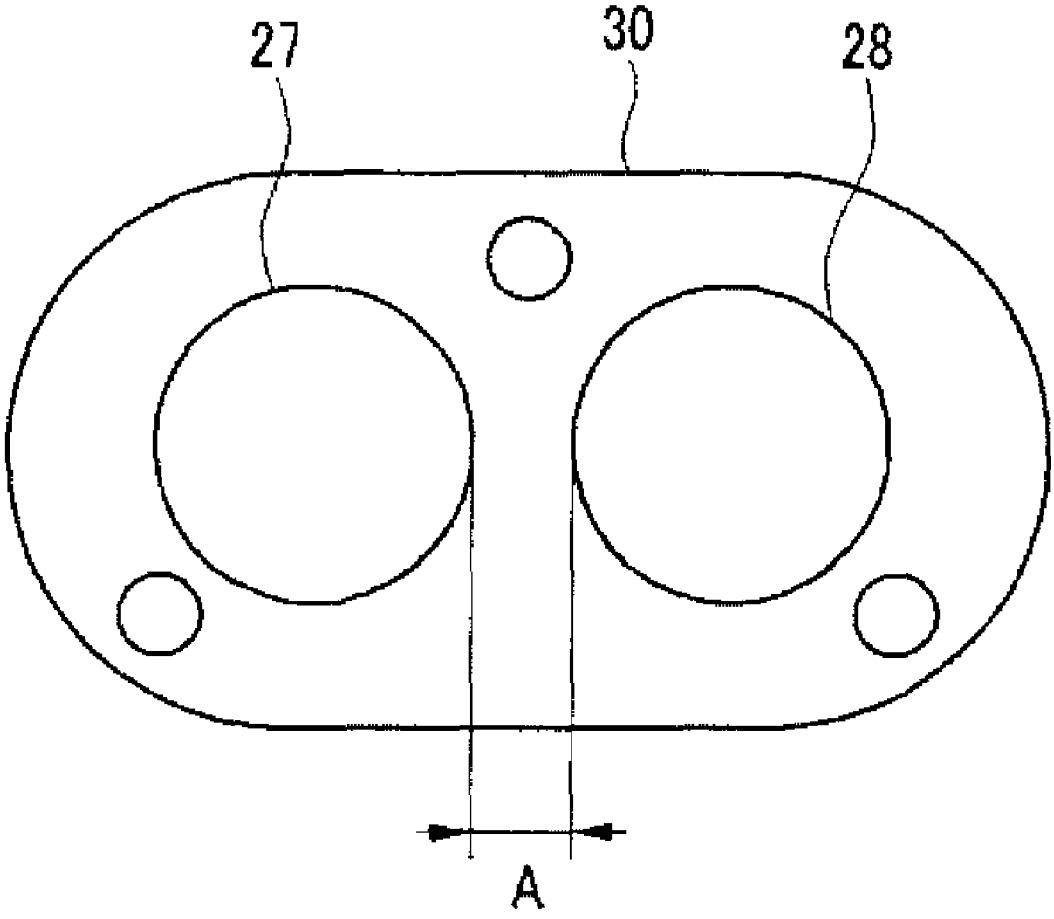
FIG. 4 is a drawing showing a structure of a flange of a cylinder head and exhaust system according to an aspect of the present invention.

FIG. 4 is a drawing showing a structure of a flange of a cylinder head and exhaust system according to an aspect of the present invention.

Referring to FIG. 4, the first single exhaust outlet 27 and the second single exhaust outlet 28 are formed to an exhaust flange 30 with a predetermined distance A therebetween, wherein the predetermined distance can be in a range of 3 mm to 15 mm.

As shown, the exhaust outlets 27 and 28 are arranged in a line on the exhaust flange 30 such that the size of the exhaust flange 30 can be reduced and durability thereof can be improved.

The first single exhaust outlet 27 and the second single exhaust outlet 28 are extended and bent at a predetermined angle α, wherein the predetermined angle α with a predetermined curvature can be in a range of 30° to 60°.

The angle of the exhaust passage is not rapidly changed as explained above, and the structure is simple such that a catalyst apparatus can be easily installed on the exhaust flange 30 and the overall weight can be reduced.

Figure 5:
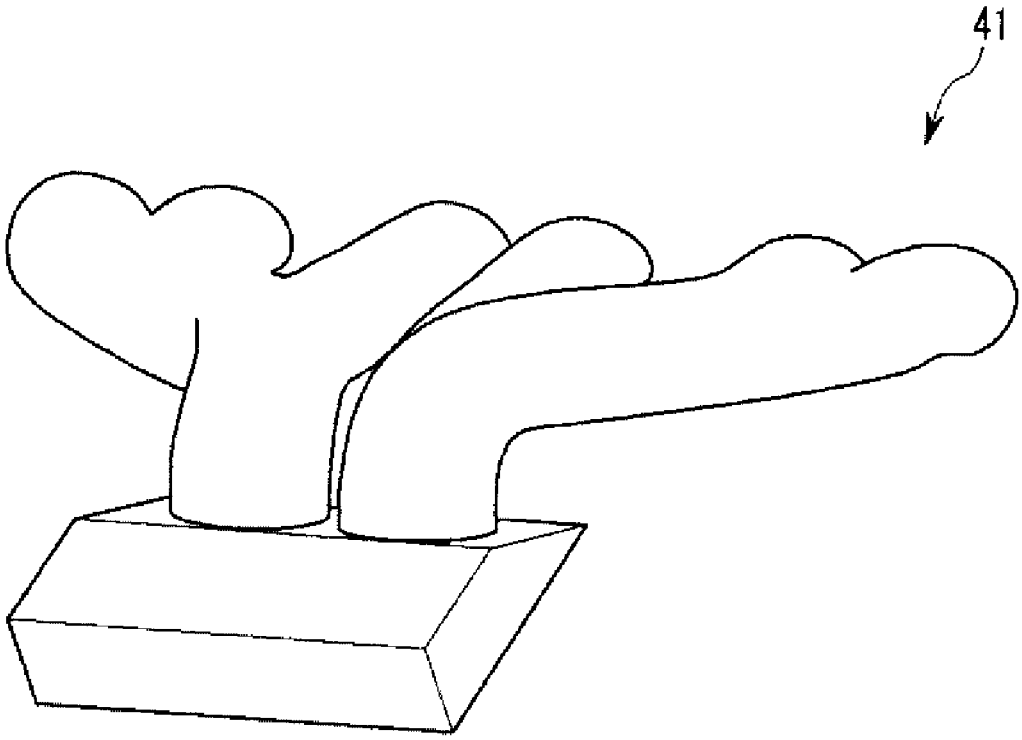
FIG. 5 is a drawing showing a mold for an exhaust manifold portion according to an aspect of the present invention.

FIG. 5 is a drawing showing a mold for an exhaust manifold portion according to an aspect of the present invention.

As shown in FIG. 5, the exhaust manifold portion of the cylinder head and exhaust system has a simple structure, two banks can be made from a single mold 41, and a core has a structure that is easily installed to the mold according to this exemplary embodiment of the present invention.

Accordingly, the productivity is improved and the mold cost is reduced.

Figure 6:
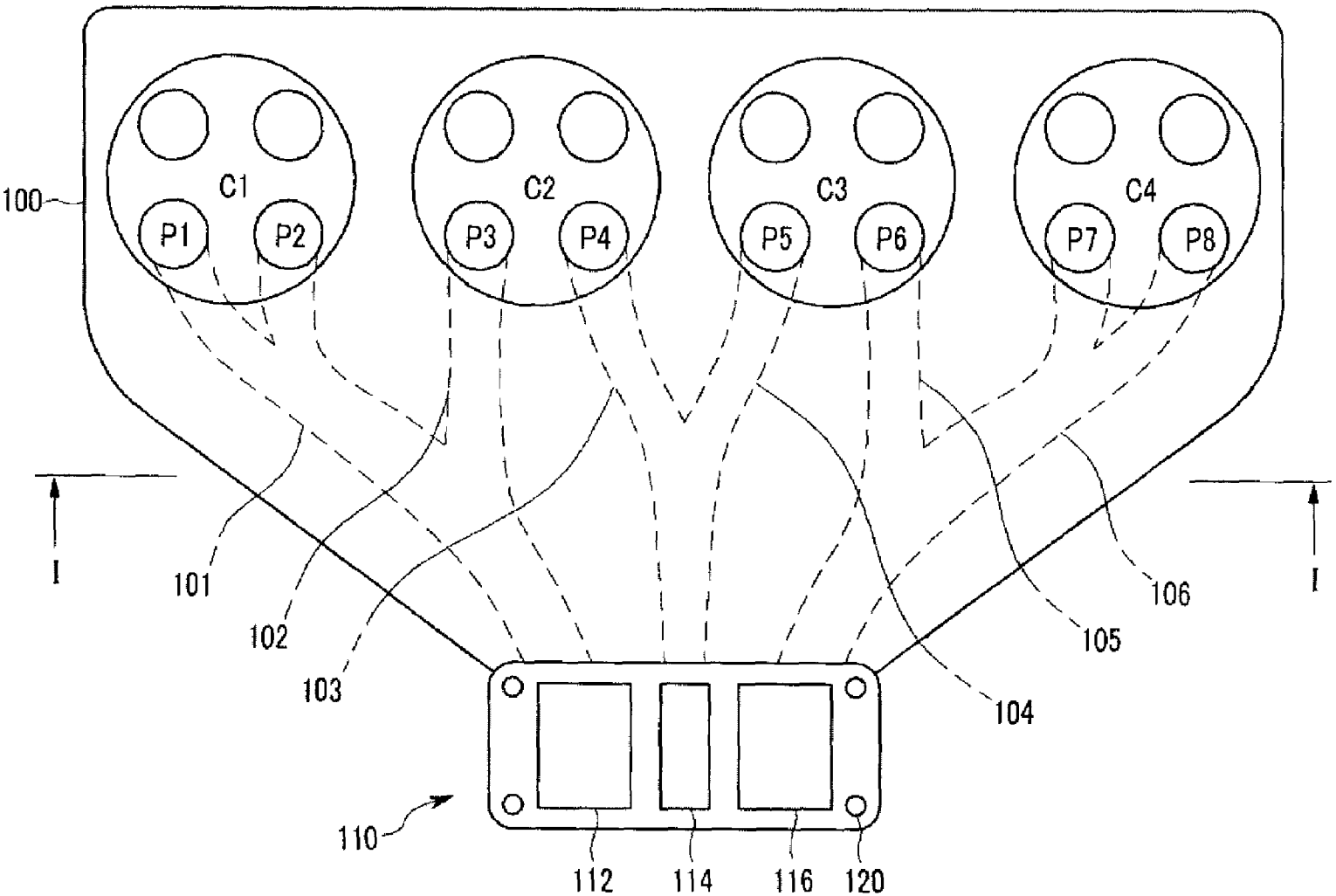
FIG. 6 is a schematic diagram showing an exhaust structure of an engine according to an aspect of the present invention.

FIG. 6 is a schematic diagram showing an exhaust structure of an engine according to an aspect of the present invention.

Referring to FIG. 6, a first cylinder C1, a second cylinder C2, a third cylinder C3, and a fourth cylinder C4 are formed in a cylinder head 100.

First and second exhaust ports P1 and P2 are formed in the first cylinder C1, and a third and fourth exhaust ports P3 and P4 are formed in the second cylinder C2. Also, fifth and sixth exhaust ports P5 and P6 are formed in the third cylinder C3, and seventh and eighth exhaust ports P7 and P8 are formed in the fourth cylinder C4.

An exhaust manifold is integrally formed with the cylinder head 100. One will appreciate that the exhaust manifold may be monolithically formed with the cylinder head. A first passage 101, a second passage 102, a third passage 103, a fourth passage 104, a fifth passage 105, and a sixth passage 106 are formed in the exhaust manifold. Here, the passages 101, 102, 103, 104, 105, and 106 are joined to an exhaust flange portion 110.

The exhaust flange portion 110 includes a first single exhaust outlet 112, a second single exhaust outlet 114, and a third single exhaust outlet 116, and has a flange structure. An exhaust pipe, a catalytic converter, or a turbocharger can be engaged with the exhaust flange portion 110 by a fixing apparatus such as a bolt that is engaged through an engaging hole 120.

The first passage 101 communicates with the first and second exhaust ports P1 and P2, the second passage 102 communicates with the third exhaust port P3, and the third passage 103 communicates with the fourth exhaust port P4. Also, the fourth passage 104 communicates with the fifth exhaust port P5, the fifth passage 105 communicates with the sixth exhaust port P6, and the sixth passage 106 communicates with the seventh and eighth exhaust ports P7 and P8.

The second passage 102 is connected substantially to a middle portion of the first passage 101 and the third passage 103 joins the fourth passage 104.

However, since the combustion gas of the first and second exhaust ports P1 and P2 are joined at first in the first passage 101 and the second passage 102 is joined to the first passage 101, the combustion gas of the first, second and third exhaust ports P1, P2 and P3 can be smoothly joined with substantially little turbulence and flow resistance therebetween.

In a like manner, the fifth passage 105 is connected substantially to a middle portion of the sixth passage 106. Since the combustion gas of the seventh and eighth exhaust ports P7 and P8 are joined at first in the sixth passage 106 and the fifth passage 105 is joined to the sixth passage 106, the combustion gas of the sixth, seventh and eighth exhaust ports P6, P7 and P8 can be smoothly joined with substantially little turbulence and flow resistance therebetween.

Combustion gas that is exhausted from the first, second, and third exhaust ports (P1, P2, and P3) is exhausted through the first single exhaust outlet 112, and the combustion gas that is exhausted from the fourth and fifth exhaust port P4 and P5 is exhausted through the second single exhaust outlet 114. Also, the combustion gas that is exhausted from the sixth, seventh, and eighth exhaust ports (P6, P7, and P8) is exhausted through the third single exhaust outlet 116.

Here, the first and third single exhaust outlets 112 and 116 are respectively connected to three exhaust ports (P1, P2, and P3 or P6, P7, and P8), and the second single exhaust outlet 114 is connected to the two exhaust ports P4 and P5. Accordingly, as shown, the respective areas of the first single exhaust outlet 112 and the third single exhaust outlet 116 are greater than that of the second single exhaust outlet 114.

For example, the width of the first and third single exhaust outlets 112 and 116 can be set at 35 mm and the width of the second single exhaust outlet 114 can be set at 25 mm. Also, the wall thickness between the first, second, and third single exhaust outlets 112, 114, and 116 can be set to be at least at 5 mm.

In various embodiments of the present invention, the exhaust manifold is integrally formed with the cylinder such that the number of components and assembly cost are reduced. In addition, a water jacket is formed inside the exhaust manifold such that the temperature of the exhaust gas can be appropriately controlled.

Also, the exhaust pipe, the turbocharger, or the catalytic converter can be easily assembled on the exhaust flange portion 110. Further, referring to FIG. 6, there are four cylinders but there are three exhaust outlets such that the exhaust flange portion 110 can be compactly designed.

Figure 7:
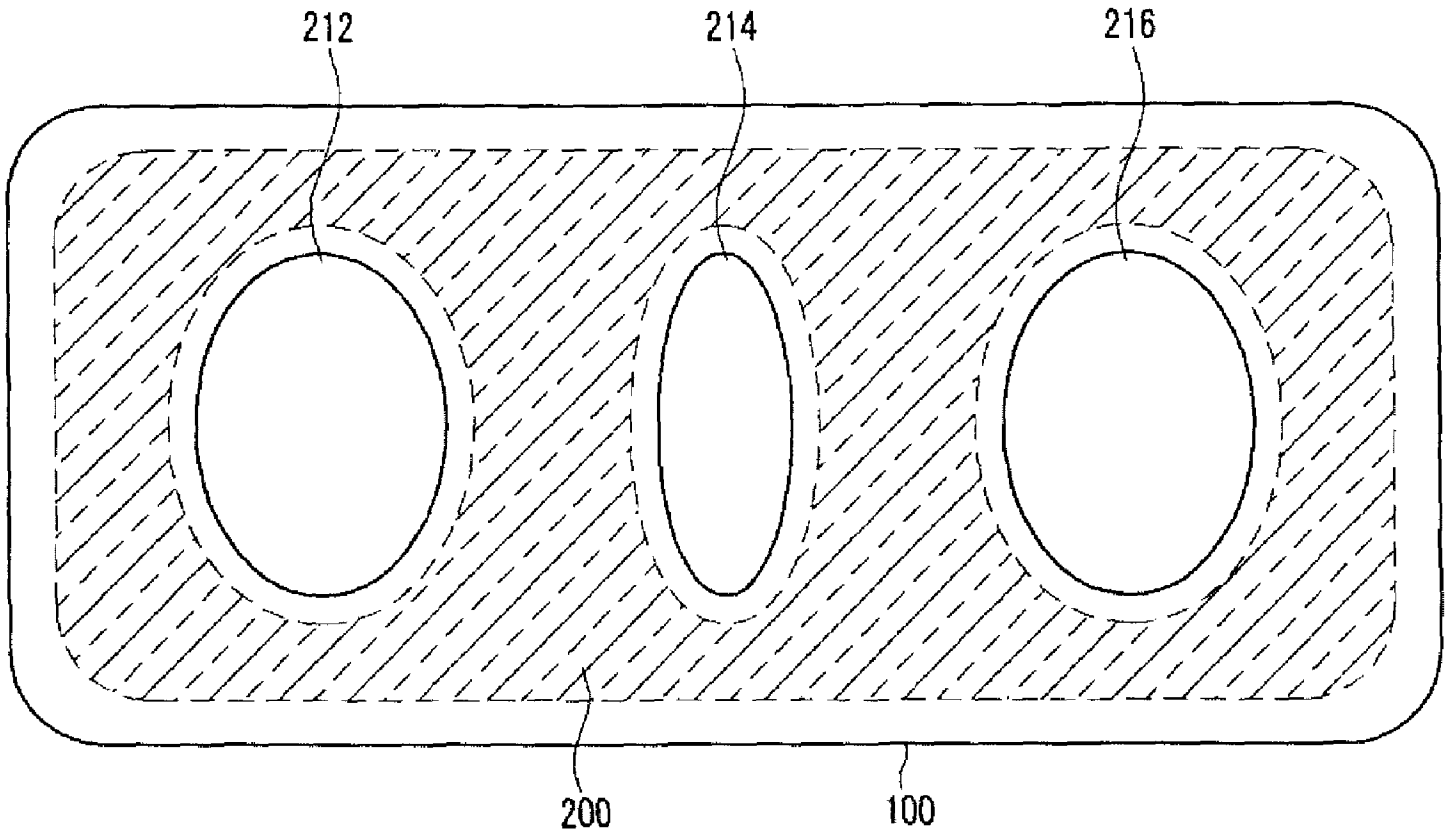
FIG. 7 is a partial cross-sectional view of an engine according to a I-I line of FIG. 6.

FIG. 7 is a partial cross-sectional view of an engine according to a I-I line of FIG. 6.

As shown in FIG. 7, a first exhaust passage 212, a second exhaust passage 214, and a third exhaust passage 216 are formed inside the exhaust manifold of the cylinder head 100.

Referring to FIG. 6 and FIG. 7, the first exhaust passage 212 communicates with the first single exhaust outlet 112, the second exhaust passage 214 communicates with the second single exhaust outlet 114, and the third exhaust passage 216 communicates with the third single exhaust outlet 116.

A water jacket 200 is formed around the first, second, and third exhaust passages 212, 214, and 216 such that the temperature of the exhaust gas can be easily controlled.

Figure 8:
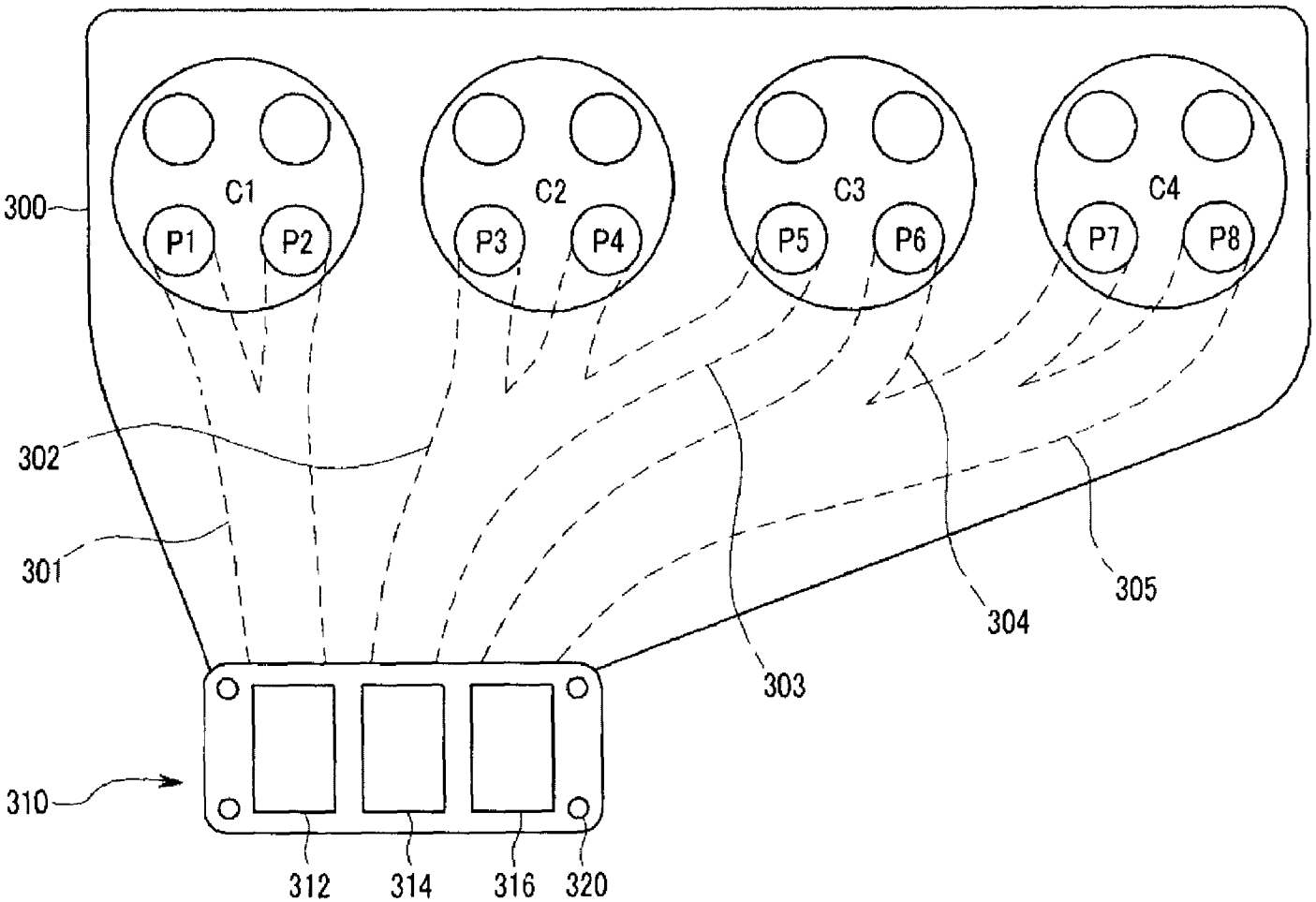
FIG. 8 is a drawing showing an exhaust structure of an engine according to an aspect of the present invention.

FIG. 8 is a drawing showing an exhaust structure of an engine according to various embodiments of the present invention.

Referring to FIG. 8, a first cylinder C1, a second cylinder C2, a third cylinder C3, and a fourth cylinder C4 are formed in a cylinder head 300.

First and second exhaust ports P1 and P2 are formed in the first cylinder C1, and third and fourth exhaust ports P3 and P4 are formed in the second cylinder C2. Also, fifth and sixth exhaust ports P5 and P6 are formed in the third cylinder C3, and seventh and eighth exhaust ports P7 and P8 are formed in the fourth cylinder C4.

An exhaust manifold is integrally formed with the cylinder head 300, and a first passage 301, a second passage 302, a third passage 303, a fourth passage 304, and a fifth passage 305 are formed in the exhaust manifold. Here, the passages 301, 302, 303, 304, and 305 are joined to an exhaust flange portion 310.

The exhaust flange portion 310 includes a first single exhaust outlet 312, a second single exhaust outlet 314, and a third single exhaust outlet 316, and has a flange structure. An exhaust pipe, a catalytic converter, or a turbocharger can be engaged with the exhaust flange portion 310 by a bolt that is inserted through an engaging hole 320.

The first passage 301 communicates with the first and second exhaust ports P1 and P2, and the second passage 302 communicates with the third and fourth exhaust ports P3 and P4. Also, the third passage 303 communicates with the fifth exhaust port P5, and the fourth passage 304 communicates with the sixth exhaust port P6. Further, the fifth passage 305 communicates with the seventh and eighth exhaust ports P7 and P8.

In the present exemplary embodiment, the first passage 301 alone communicates with the first single exhaust outlet 312, and the third passage 303 joins substantially a middle portion of the second passage 302 and communicates with the second single exhaust outlet 314.

Also, the fourth passage 304 joins substantially a middle portion of the fifth passage 305 and communicates with the third single exhaust outlet 316.

According to various embodiments, the exhaust manifold is integrally formed with the cylinder head such that cost is decreased and durability of the exhaust manifold is improved.

Also, the exhaust flange portion is formed at an end portion that is extended from the cylinder head, and a water jacket is formed around the passages thereof such that the exhaust temperature can be easily controlled. Accordingly, exhaust resistance thereof is reduced such that fuel consumption is reduced.

Also, the catalytic converter can be disposed closer to the exhaust port such that the period during which the catalytic converter reaches a predetermined temperature can be shortened.

As a result, in various aspects of the present invention, the temperature of the exhaust gas is appropriately controlled such that fuel consumption can be reduced in the engine in which an exhaust manifold and a cylinder head are integrally formed according to various embodiments of the present invention.

Further, the spatial utility of the engine compartment can be improved.

Also, a catalyst apparatus is disposed close to the exhaust flange portion such that the efficiency thereof can be improved, and the number of exhaust outlets is reduced such that a compact engine can be designed.

In addition, the exhaust manifold is integrally formed with the cylinder head such that cost for assembly is reduced and durability is improved.

For convenience in explanation and accurate definition in the appended claims, the terms "inside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. An engine in which an exhaust manifold is integrally formed with a cylinder head, the engine comprising:

an exhaust manifold in which at least first and second passages are formed, the first passage connected to at least one exhaust port disposed in a first cylinder; and the second passage connected to at least one exhaust port disposed in a second cylinder;

wherein the first passage and the second passage join together to communicate with a first single exhaust outlet, and wherein first and second exhaust ports are formed in the first cylinder and third and fourth exhaust ports are formed in the second cylinder that is adjacent to the first cylinder, and wherein the first passage at the first cylinder communicates with the first and second exhaust ports and the second passage at the second cylinder communicates with the third exhaust port; and a third cylinder that is formed adjacent to the second cylinder and that has fifth and sixth exhaust ports, wherein a third passage that communicates with the fourth exhaust port and a fourth passage that communicates with the fifth exhaust port are formed in the exhaust manifold, and the third and fourth passages join together to communicate with a second single exhaust outlet.

2. The engine of claim 1, wherein the first single exhaust outlet is extended and bent at a predetermined angle in a range of about 30° to about 60°.

3. The engine of claim 1, wherein a first exhaust port is formed in the first cylinder, and second and third exhaust ports are formed in the second cylinder that is adjacent to the first cylinder, and wherein the first passage of the first cylinder communicates with the first exhaust port and the second passage at the second cylinder communicates with the second exhaust port.

4. The engine of claim 1, wherein the second single exhaust outlet and the first single exhaust outlet are adjoined.

5. The engine claim 1, wherein the first single exhaust outlet and the second single exhaust outlet are extended and bent at a predetermined angle in a range of about 30° to about 60°, and wherein the first single exhaust outlet and the second single exhaust outlet are formed to an exhaust flange with a predetermined distance therebetween, wherein the predetermined distance is in a range of about 3 mm to about 15 mm.

6. The engine of claim 1, further comprising a fourth cylinder in which seventh and eighth exhaust ports are formed and that is disposed next to the third cylinder, wherein a fifth passage that communicates with the sixth exhaust port and a sixth passage that communicates with the seventh and eighth exhaust ports are formed in the exhaust manifold, and the fifth and sixth passages join together to communicate with a third single exhaust outlet.

7. The engine of claim 6, wherein the first, second, and third single exhaust outlets are extended and bent at a predetermined angle in a range of about 30° to about 60°, and wherein the first, second, and third single exhaust outlets are formed to an exhaust flange with a predetermined distance therebetween in series, wherein the predetermined distance is in a range of about 3 mm to about 15 mm.

8. The engine of claim 6, wherein the fifth passage is joined with the sixth passage after the sixth passage is formed.

9. The engine of claim 1, further comprising a third cylinder in which fifth and sixth exhaust ports are formed and that adjoins the second cylinder, wherein a third passage that communicates with the fourth exhaust port and a fourth passage that communicates with the fifth and sixth exhaust ports are formed, and the third and fourth passages join together to communicate with a second single exhaust outlet.

10. The engine of claim 9, wherein the third passage is joined with the fourth passage after the fourth passage is formed.

11. The engine of claim 10, wherein the first, second, and third single exhaust outlets are extended and bent at a predetermined angle in a range of about 30° to about 60°, and wherein the first, second, and third single exhaust outlets are formed to an exhaust flange with a predetermined distance therebetween in series, wherein the predetermined distance is in a range of about 3 mm to about 15 mm.

12. An engine in which an exhaust manifold is integrally formed with a cylinder head, comprising:

a first cylinder that includes first and second exhaust ports;

a second cylinder that includes third and fourth exhaust ports and is disposed adjacent to the first cylinder;

a third cylinder that includes fifth and sixth exhaust ports and is disposed adjacent to the second cylinder; and the exhaust manifold in which a first passage that communicates with the first and second exhaust ports, a second passage that communicates with the third and fourth exhaust ports, and a third exhaust passage that communicates with the fifth exhaust port are formed;

wherein the first passage is connected to a first single exhaust outlet, and the second passage and the third passage join together to communicate with a second single exhaust outlet; and a fourth cylinder that includes seventh and eighth exhaust ports and is formed adjacent to the third cylinder;

wherein a fourth passage that communicates with the sixth exhaust port and a fifth passage that communicates with the seventh and eighth exhaust ports are formed in the exhaust manifold, and the fourth and fifth passages join together to communicate with a third single exhaust outlet.

13. The engine of claim 12, wherein the third passage is joined with the second passage after the second passage is formed.

14. The engine claim 12, wherein the first single exhaust outlet and the second single exhaust outlet are extended and bent at a predetermined angle in a range of about 30° to about 60°, and wherein the first single exhaust outlet and the second single exhaust outlet are formed to an exhaust flange with a predetermined distance therebetween, wherein the predetermined distance is in a range of about 3 mm to about 15 mm.

15. The engine in which the exhaust manifold is integrally formed with the cylinder head of claim 12, wherein the first, second, and third single exhaust outlets are extended and bent at a predetermined angle in a range of about 30° to about 60°, and wherein the first, second, and third single exhaust outlets are formed to an exhaust flange with a predetermined distance therebetween in series, wherein the predetermined distance is in a range of about 3 mm to about 15 mm.

16. The engine of claim 12, wherein the fifth passage is joined with the fourth passage after the fifth passage is formed.

* * * * *